US006568460B1

(12) United States Patent
Kneppe et al.

(10) Patent No.: US 6,568,460 B1
(45) Date of Patent: May 27, 2003

(54) METHOD AND APPARATUS FOR ADJUSTING THE PROFILE OF A CONTINUOUSLY CAST SLAB, PARTICULARLY OF A THIN SLAB

(75) Inventors: Günter Kneppe, Hilchenbach (DE); Hans Streubel, Erkrath (DE)

(73) Assignee: SMS Schloemann-Siemag Aktiengesellschaft, Düsseldorf (DE)

( * ) Notice: Subject to any disclaimer, the term of this patent is extended or adjusted under 35 U.S.C. 154(b) by 0 days.

(21) Appl. No.: 09/543,453

(22) Filed: Apr. 5, 2000

(30) Foreign Application Priority Data

Apr. 10, 1999 (DE) ..... 199 16 173

(51) Int. Cl.[7] ..... B22D 11/128
(52) U.S. Cl. ..... 164/442; 164/448
(58) Field of Search ..... 164/442, 448, 164/484

(56) References Cited

U.S. PATENT DOCUMENTS

| | | |
|---|---|---|
| 4,294,307 A | 10/1981 | Wiesinger et al. |
| 4,979,556 A | 12/1990 | Braun et al. |

FOREIGN PATENT DOCUMENTS

| | | | |
|---|---|---|---|
| DE | 4306853 | | 9/1994 |
| DE | 197 45 056 A1 | | 4/1999 |
| EP | 0545104 | | 6/1993 |
| FR | 1158172 | * | 7/1969 |

OTHER PUBLICATIONS

Patent Abstracts of Japan, vol. 1996, No. 08, Aug. 30, 1996 & JP 08 108208 A (Nippon Steel Corp) Apr. 30, 1996.
Patent Abstracts of Japan, vol. 008, No. 234, Oct. 26, 1984 & JP 59 113963 A (Kawasaki Seitetsu KK), Jun. 30, 1984.

* cited by examiner

*Primary Examiner*—M. Alexandra Elve
*Assistant Examiner*—Len Tran
(74) *Attorney, Agent, or Firm*—Friedrich Kueffner

(57) ABSTRACT

A method and an apparatus for adjusting the profile of a continuously cast slab, particularly of a thin slab, wherein the profile is determined in accordance with given requirements with respect to its camber or wedge shape by the gap geometry of strand guide rollers of the guide segments of a strand guiding system. The method includes determining the adjustment of the strand guide rollers at least in the area of the residual solidification and the adjusting forces of adjusting means required for this purpose in such a way that a predeterminable desired value for the slab profile can be adjusted for any characteristic state of operation.

7 Claims, 2 Drawing Sheets

METHOD AND APPARATUS FOR ADJUSTING THE PROFILE OF A CONTINUOUSLY CAST SLAB, PARTICULARLY OF A THIN SLAB

BACKGROUND OF THE INVENTION

1. Field of the Invention

The present invention relates to a method for adjusting the profile of a continuously cast slab, particularly of a thin slab, wherein the profile is determined in accordance with given requirements with respect to its camber or wedge shape (conicity) by the gap geometry of strand guide rollers of the guide segments of a strand guiding system.

The invention also relates to an apparatus for carrying out the method.

2. Description of the Related Art

Increased requirements are made of the slab profile and especially the thin slab profile of a casting machine with respect to the camber or the wedge shape in order to produce the required profile tolerances, particularly in the case of small final rolling thicknesses.

The slab profile is essentially dependent on the roll gap geometry in the area of the residual solidification of the strand. Alignment errors, roll wear, elastic deformations of the segment, temperature influences and different casting widths, as well as a different solidification profile over the casting length and width, result in a roll gap geometry and, thus, a casting profile which partially does not meet the high requirements of the rolling mill and, thus, of the end product.

These relationships and reasons are known in the art. DE 197 45 056 discloses a method of producing slabs in a continuous casting plant with a strand guiding system divided into segments and arranged following a casting mold, composed of a two-part segment frame whose frame parts are clamped together by means of hydraulic cylinders, wherein pairs of oppositely located rollers are mounted in the frame parts for supporting and for conveying the solidifying cast strand, and wherein at least one of these rollers, i.e., the drive roller, is adjusted for transmitting the strand conveying forces with a defined adjusting force relative to the cast strand, such that the clamping of the segment frame parts takes place steplessly by position-controlled and force-controlled segment adjusting cylinders which also apply the adjusting force for the drive roller required for transmitting the strand conveying forces.

A continuous casting plant for carrying out the method for producing slabs contains four position-controlled and force-controlled segment adjusting cylinders which connect the two segment frame parts at a distance without spacers and clamp the segment frame parts relative to each other.

DE 43 06 853 A1 describes a strand guiding system in continuous casting plants for producing slabs, particularly in accordance with the casting and rolling method, with rollers which are arranged in pairs opposite each other and can be adjusted to different strand thicknesses, wherein the rollers are mounted at frames or stand parts of the strand guiding system connected through tension rods, and wherein the tension rods are formed by piston/cylinder units and spacer pieces are placed in the flux of the force of the piston/cylinder units between upper and lower frame parts. Arranged between the spacer piece and the cylinder of the piston/cylinder unit is an annular hydraulic cylinder which surrounds the piston rod and whose annular piston supports with frictional engagement the spacer piece. The annular hydraulic cylinders are supported on side frames and the side frames connect at least two lower frames to a segment of the strand guiding system.

EP 0 545 104 B1 discloses a method of continuously casting slabs or blooms in a continuous casting plant with a soft reduction section which includes rollers which can be adjusted individually or as a segment relative to each other by means of hydraulic cylinders, wherein the clear distance between the rollers is steplessly adjustable by means of spindles. The adjusting force during casting is reduced and the spindles are adjusted under reduced load to a desired opening width. For this purpose, it is proposed to continuously measure the difference between cylinder force and ferrostatic load. In an apparatus for carrying out the method in a continuous casting plant with soft reduction section, which includes rollers which can be adjusted individually or as a segment by means of hydraulic cylinders relative to each other and in which the clear distance between the rollers can be adjusted steplessly, the spindles are supported on pressure cells which continuously measure the adjusting force and are connected to an adjusting drive.

In the prior art discussed above, those skilled in the art cannot find any suggestions in what manner or with what means it might be possible to meet the concrete requirements with respect to the camber and the wedge shape of slab profiles, or how in the case of small final rolling thicknesses the profile tolerances required in that case can be produced or maintained.

SUMMARY OF THE INVENTION

Starting from the prior art discussed above, it is the primary object of the present invention to propose a novel strand guiding concept which, in addition to being less expensive, makes it possible to influence in a targeted manner the camber and wedge shape of a slab profile, particularly of a thin slab profile.

In accordance with the present invention, taking into consideration the known fact that the slab profile is dependent substantially on the roll gap geometry in the area of the residual solidification of the strand, the above object is met by determining the adjustment of the strand guide rollers at least in the area of the residual solidification and the adjusting forces of adjusting means required for this purpose in such a way that a predeterminable desired value for the slab profile can be adjusted for any characteristic state of operation.

The computation can be carried out by means of on-line process models. The adjustment of the rollers to a roller gap geometry in the area of the residual solidification of the strand which can be achieved in accordance with the present invention makes it possible in an optimum manner to meet the predetermined requirements with respect to camber and wedge shape of a slab profile. Also compensated by the method are alignment errors, roller wear, elastic deformations of the segment due to ferrostatic loads and the temperature influence as well as different casting widths.

In accordance with a further development of the method, the determination of the desired values is carried out by way of previous computation for the preadjustment of the strand guide rollers as well as on-line during operation for the on-line adjustment of the rollers.

In accordance with the invention, desired values can be preset in dependence on different operational loads, in dependence on different slab dimensions, in dependence on different steel qualities, or in dependence on different casting speeds and casting temperatures.

The desired values are preferably preset in dependence on different plant conditions, such as state of alignment, state of wear and/or state of thermal expansion, wherein the desired values are preferably preset in accordance with at least two characteristic states of operation.

The method according to the invention is especially characterized in that adjusting forces act on a guide segment on one side, either the loose side or the fixed side, preferably on the fixed side, wherein the adjusting forces influence in a targeted manner in the middle area the deformation of the segment for achieving a desired slab profile.

In the apparatus for adjusting the slab profile of a continuously cast slab, particularly of a thin slab, wherein the profile is determined in accordance with given requirements with respect to its camber and/or wedge shape by the gap geometry of strand guide rollers of a strand guiding system, and wherein the rollers are mounted in individual strand guide segments and in pairs opposite each other on frame parts which form a fixed side and a loose side and are clamped together by adjusting means through tension rods at their outer end portions, the invention provides that at least one force application means is arranged in the middle portion of the frame parts, wherein the force application means is configured to apply tensile forces as well as compressive forces.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
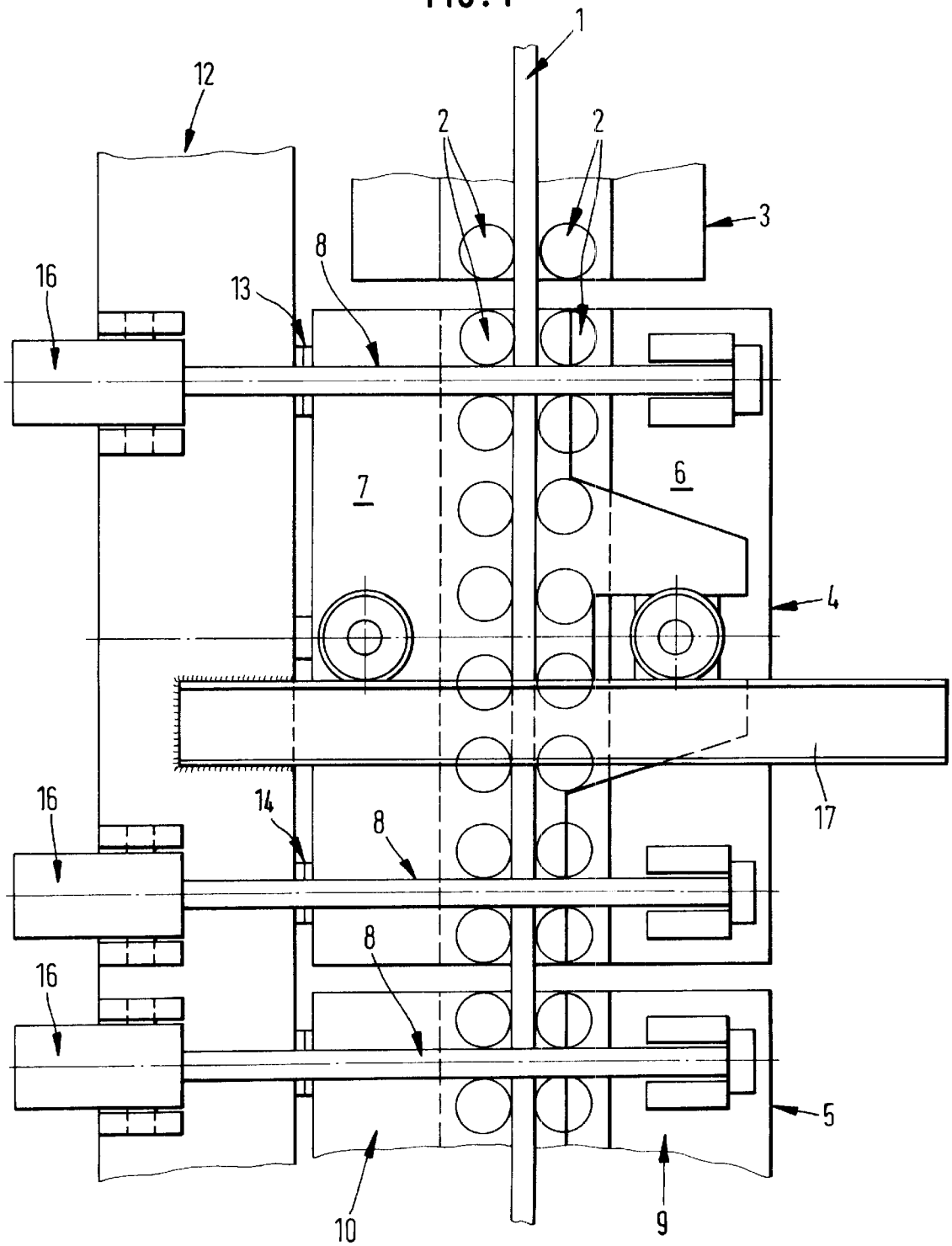
FIG. 1 is a side view of a segment of an apparatus for adjusting the slab profile of a continuously cast slab in accordance with the strand guiding concept of the present invention.

FIG. 1 is a partial view of a strand guide apparatus showing the thin slab 1 travelling through the successively arranged guide segments 3, 4 and 5, wherein only the guide segment 4 is illustrated entirely. The guide segment 4 is arranged on the support frame 12 and includes pairs of oppositely arranged frame parts 10, 9 forming a fixed side 7 and a loose side 6 and clamped together at their outer end portions by adjusting means 16 through tension rods 8.

Figure 2:
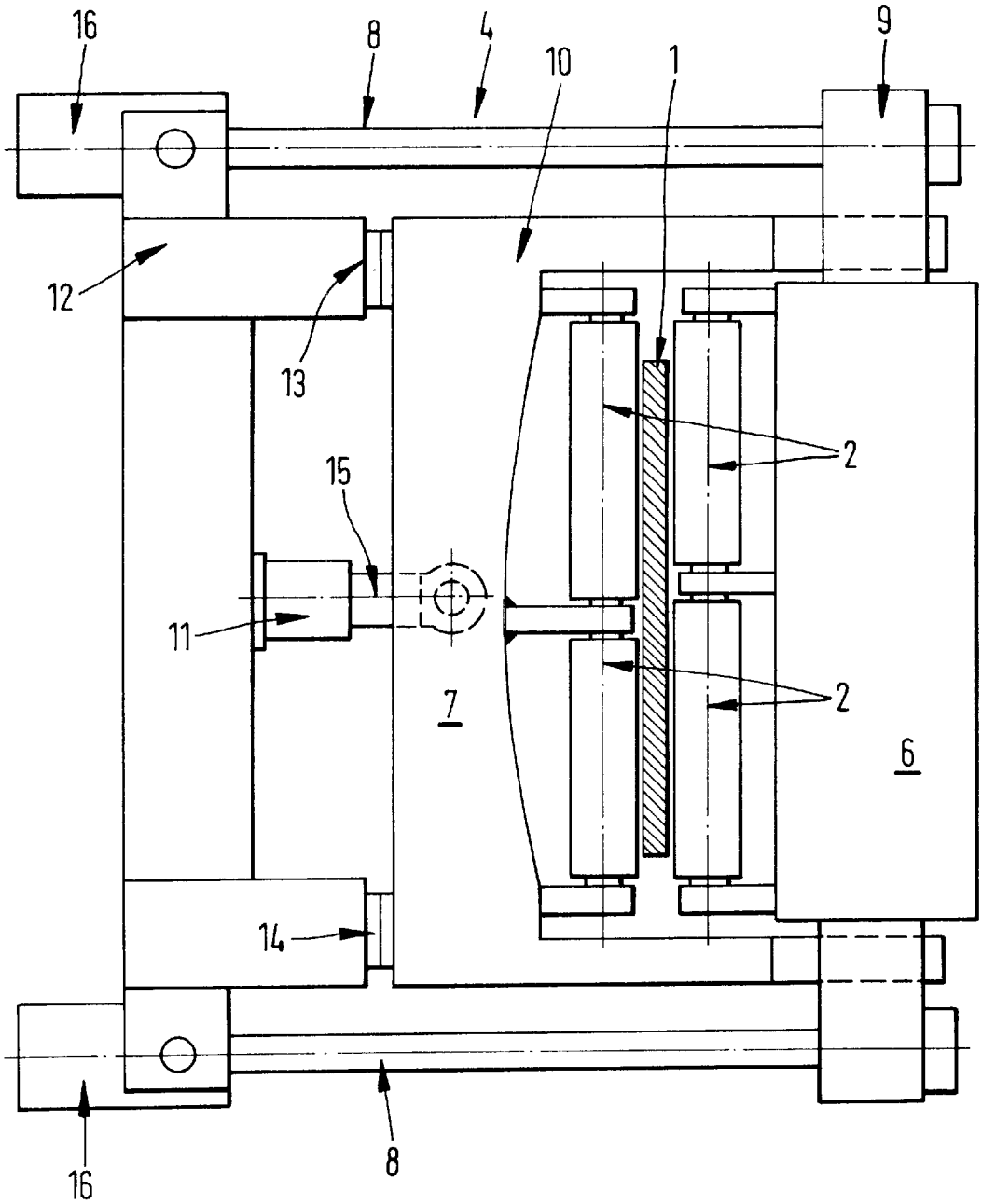
FIG. 2 is a sectional view of the strand guiding apparatus according to FIG. 1 taken in a plane extending perpendicularly of the strand.

In accordance with the present invention, the middle portion of the frame part 10 is provided with a force application means 11, shown in FIG. 2, wherein the force application means 11 is constructed for applying tensile forces as well as compressive forces.

The force application means 11 is a hydraulically or pneumatically actuated plunger cylinder. This plunger cylinder is distance-controlled in both directions for applying tension or pressure. The plunger cylinder acts on the fixed side of the frame part 10 and is fixedly connected to the support frame 12. This force application means can also be an adjusting spindle drive driven by an electric motor.

FIG. 1 further shows that individual guide segments 3 to 5 are received by a support frame 12 which connects the segments to form a strand guiding system. The frame parts 6, 7 are constructed with a relatively high section modulus against bending but they are elastically deformable within limits under the influence of the force of the force application means 11. For this purpose, the frame part 10 of the fixed side 7 can rest at its ends on fixed stops 13, 14 of the support frame 12 and can be elastically deformed in a targeted manner by means of a force applied by the force application means, for example, such that the frame part 10 is deformed into a concave shape by the influence of tension. For example, the magnitude of the deformation in the middle portion may be 1 to several mm or a fraction of a mm, so that a slight but necessary camber of the strand profile is achieved.

The piston rod 15 of the force application means 11 is hinged to the frame part 10 on the fixed side 7.

FIG. 1 further shows that, for exchanging the guide segment, the guide segment is movable on a rail 17 which is fixedly connected to the support frame.

This feature of the present invention makes it possible to carry out a quick exchange of individual guide segments 3 to 5, so that a change of the thin slab profile can be taken into consideration with relatively low costs when there is a program change of the continuous casting program. The adjusting means 16 of the tension rods 8 may be hydraulically or electromechanically excitable force application means.

Important for an elastic deformation of the frame parts 10 is the fact that the frame part 10 is supported on the stops 13, 14 arranged on the frame 12 for producing a reaction force against the influence of the force of the tension rod 15 for obtaining an elastic bending of the frame part 10 in the range of millimeters.

FIGS. 1 and 2 show together the advantageous construction of the apparatus for adjusting the slab profile of a continuously cast slab, particularly a thin slab 1. The profile is determined in accordance with the given requirements with respect to its camber and/or wedge shape by the gap geometry of the strand guide rollers 2 of the strand guiding system. The rollers are mounted opposite each other in pairs in individual strand guide segments 3 to 5 on frame parts 10, 9 which form a fixed side 7 and a loose side 6 and are clamped together at their outer end portions by adjusting means 16 through tension rods 8.

While specific embodiments of the invention have been shown and described in detail to illustrate the inventive principles, it will be understood that the invention may be embodied otherwise without departing from such principles.

We claim:

1. An apparatus for adjusting a slab profile of a continuously cast slab, wherein the profile is determined in accordance with given requirements concerning camber and/or wedge shape by a gap geometry of strand guide rollers of a strand guiding system, the apparatus comprising frame parts forming a fixed side and a loose side, wherein the strand guide rollers are mounted in pairs located opposite each other in individual strand guide segments on the frame parts, wherein supports are provided between each pair of rollers, the frame parts being clamped together at outer end portions thereof by adjusting means through tension rods, wherein, for adjusting the slab profile through elastic deformation of the fixed side by applying tensile forces and compressive forces, at least one force application means is arranged in a middle portion, and wherein the at least one force application means is configured for applying tensile forces and compressive forces, causing the frame part having a concave deformation.

2. The apparatus according to claim 1, wherein the force application means is a hydraulically or pneumatically operated plunger cylinder, and wherein the plunger cylinder is configured to be distance-controlled and actuated in both directions for tension or pressure.

3. The apparatus according to claim 1, wherein the force application means is an adjusting spindle drive driven by an electric motor.

4. The apparatus according to claim 1, wherein individual segments are mounted in the support frame for forming the strand guiding system, wherein the frame parts have a high section modulus against bending.

5. The apparatus according to claim 1, comprising rails fixedly connected to the support frame, wherein the segments are configured to travel on the rails for exchanging the segments.

6. The apparatus according to claim 1, wherein the adjusting means are hydraulically or electromechanically excitable force application means.

7. The apparatus according to claim 1, wherein the at least one force application means is fixedly mounted on the support frame, and wherein a piston rod of the force application means is mounted in the frame part on the fixed side.

* * * * *